US009108833B2

(12) United States Patent
Vesentini

(10) Patent No.: US 9,108,833 B2
(45) Date of Patent: Aug. 18, 2015

(54) APPARATUS FOR SCREWING A RING NUT OF A TRIGGER PUMP ON A CONTAINER

(75) Inventor: Renzo Vesentini, Marmirolo (IT)

(73) Assignee: REJVES S.R.L., Marmiolo (Mantova) (IT)

( * ) Notice: Subject to any disclaimer, the term of this patent is extended or adjusted under 35 U.S.C. 154(b) by 572 days.

(21) Appl. No.: 13/514,678

(22) PCT Filed: Dec. 7, 2010

(86) PCT No.: PCT/IB2010/055625
§ 371 (c)(1),
(2), (4) Date: Jun. 8, 2012

(87) PCT Pub. No.: WO2011/070505
PCT Pub. Date: Jun. 16, 2011

(65) Prior Publication Data

US 2012/0272502 A1 Nov. 1, 2012

(30) Foreign Application Priority Data

Dec. 11, 2009 (IT) ..... PR2009A0101

(51) Int. Cl.
*B67B 3/20* (2006.01)

(52) U.S. Cl.
CPC ..... *B67B 3/2033* (2013.01); *B67B 3/2073* (2013.01); *B67B 2201/12* (2013.01); *Y10T 29/49826* (2015.01); *Y10T 29/53* (2015.01)

(58) Field of Classification Search
CPC ..... B67B 3/00; B67B 3/20; B67B 3/2033; B67B 3/2073; B67B 2201/12; Y10T 29/53; Y10T 29/49826
See application file for complete search history.

(56) References Cited

U.S. PATENT DOCUMENTS

| | | | |
|---|---|---|---|
| 5,207,048 | A | 5/1993 | Wysocki |
| 5,479,762 | A | 1/1996 | Bliss |

FOREIGN PATENT DOCUMENTS

| | | |
|---|---|---|
| AU | 630331 | 10/1992 |
| EP | 0559946 | 9/1993 |
| EP | 0690020 | 1/1996 |
| WO | 2006122670 | 11/2006 |
| WO | 2007/017131 | 2/2007 |
| WO | 2008/128057 | 10/2008 |

OTHER PUBLICATIONS

International search report dated Jun. 8, 2011 in corresponding PCT/IB2010/055625.

*Primary Examiner* — Moshe Wilensky
(74) *Attorney, Agent, or Firm* — Young & Thompson

(57) ABSTRACT

A method for screwing a ring nut of a trigger-shaped (5) pump or trigger (1) on a vessel (6), the pump or trigger being provided with a threaded fixing ring nut (2) by a gripping lever assembly (11). The method includes the steps of: screwing the ring nut on the threaded mouth of the vessel by screwing it to the body until the screwing torque does not reach a preset value; performing a first detachment of elements for tightening the ring nut; rotating the tightening elements (11), by an associated motor, relocating them in their starting configuration, by clearing the trigger by the presence of the levers (11) themselves; lastly, performing a further opening of the tightening elements from the ring nut (2); the driving being necessary for completely opening the gripper and clearing the trigger.

10 Claims, 4 Drawing Sheets

APPARATUS FOR SCREWING A RING NUT OF A TRIGGER PUMP ON A CONTAINER

FIELD OF THE INVENTION

The present invention refers to the field of the screwing systems for applying on vessels, trigger pumps provided with fixing ring nut and more particularly refers to a method and an apparatus for screwing the ring nut of the trigger pump by gripping lever means. As it is known, a trigger pump is provided with a suction device formed by a pipe adapted to be inserted in the vessel, moreover it comprises an outer toothed ring nut which can freely rotate with respect to the body of the pump and is inwardly threaded to be associated to the corresponding thread made on the neck of the vessel to be capped.

The screwing head is used with a carousel-type (rotating) machine or a linear-type machine and, in correspondence of each position of the machine, it is provided a plate supporting the vessel to be screwed, while the screwing head comprises means for gripping the ring nut of the pump which screw the pump on said vessel.

The gripping means are formed by at least a pair of rollers operatively connected by two arms to the driving device of the screwing head so that, once they contact the ring nut, they screw the ring nut to the vessel.

After the tightening, in order to avoid that the torque applied to the head is greater than the resistance of the thread, a magnetic friction, or an electric motor, terminates the rotating action to the rollers themselves.

A disadvantage of the prior art using the tightening rollers is due to the fact that said rollers contact the ring nut in a single contact point around the circumference and in few points along the axis of the teeth: for avoiding a slippage between these teeth and the knurled ring nut it is necessary to generate a strong action, in other words a determined pressure on the ring nut, which forms strains and abrasions on the same.

Another disadvantage is due to the fact that after some screwing cycles, there is a play between the mechanism driving the rollers which causes a tightening error during the screwing.

Another disadvantage of the system is due to the fact that it is not possible to screw teeth-free smooth ring nuts.

SUMMARY OF THE INVENTION

It is an object of the present invention to eliminate the above-mentioned disadvantages by implementing a method or process and its associated apparatus, for screwing a trigger pump, provided with gripping means adapted to rotate the component to be screwed, that is the trigger pump ring nut itself. Practically, the gripping means establish the contact with the ring nut by gripping firmly it by two or more grippers or jaws and rotating it, while screwing it to the body, until the screwing torque does not reach a predetermined value.

Another object of the invention consists of allowing said screwing operation to the trigger pumps provided with a dosing lever, in other words a lever adapted to drive the outflow of the fluid received in the vessel or dispenser, through the suction device and an associated nozzle. Generally, the lever extends downwardly as, for example, the trigger of a gun, to interfere with the gripping area of the ring nut used by the gripper. While this fact is not an hindrance during the gripping step, the problem could appear at the end of the screwing of the trigger pump ring nut, because the screwing gripper can be in any position and therefore also between the ring nut and the trigger, consequently hindering the releasing (reopening) of the trigger pump plug.

With the present process, it is possible also to operate on trigger pump plugs in a completely safe way because it is provided, before the complete reopening of the ring nut grippers, a partial opening or detachment from the ring nut, that is sufficient to reset the starting arrangement of the head or gripper in order to take it again in a safe condition for a complete release.

What has been described before can be implemented by coupling the screwing head (with gripping levers or jaws) to driving means with an encoder capable of detecting, at any instant, the position of the rotating shaft of the jaws and determining the presence of an interference with the trigger and in any case of moving again said jaws to the starting position, by rotating them of a corresponding angular value.

ADVANTAGES

The advantages that we have with the present invention can be set forth in the following:

- reduction of the mechanisms for driving the screwing,
- no plays between the rotation transmission and the grippers,
- positive grip of the ring nut in a wrapping way both on the diameter and on its height, so that it is obtained a greater contact surface between the gripper and trigger and a reduced specific pressure.

Said objects and advantages are all met by the screwing process and its apparatus, object of the present invention, which is characterized by the attached claims.

BRIEF DESCRIPTIONS OF THE DRAWINGS

These and other features will be better understood from the following description of some embodiments, shown in an illustrative and non limiting way, in the attached drawings.

DISCLOSURE OF THE INVENTION, METHOD AND APPARATUS

Figure 1:
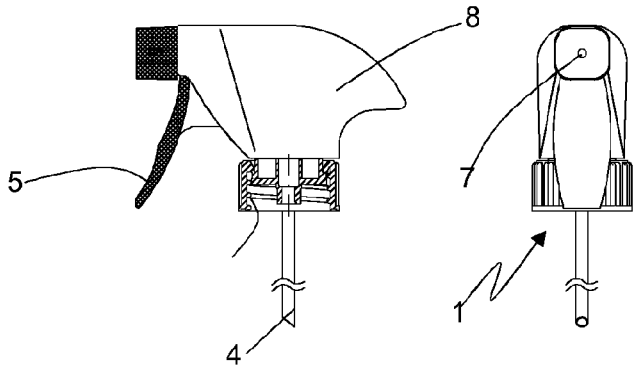
FIG. 1 shows four views of a trigger pump.
Figure 2:
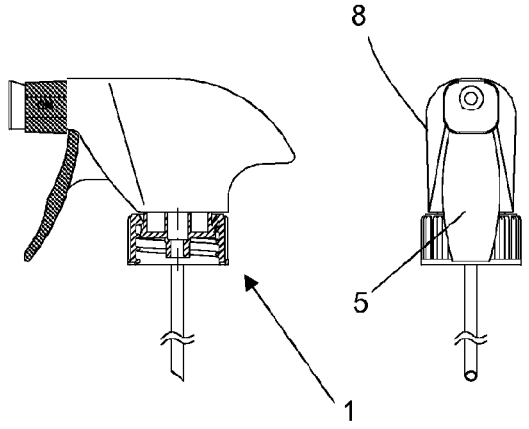
FIG. 2 shows a trigger with the underlying vessel before its screwing.
Figure 2:
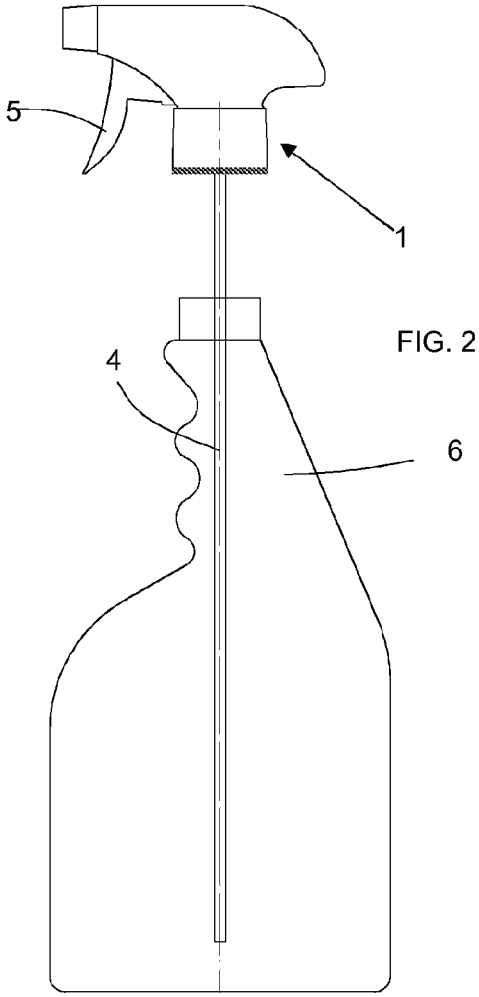
Figure 3:
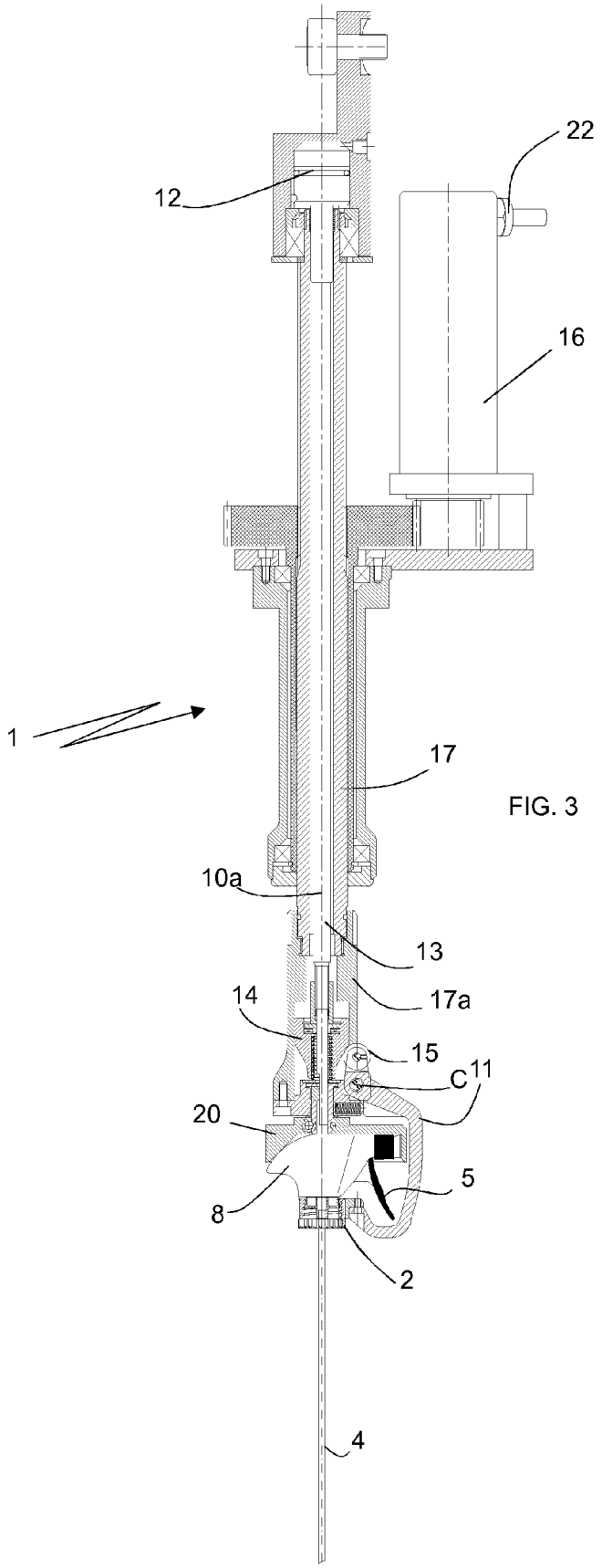
FIG. 3 shows a gripping and screwing head implementing the method of the invention, provided with a driving system.
Figure 4:
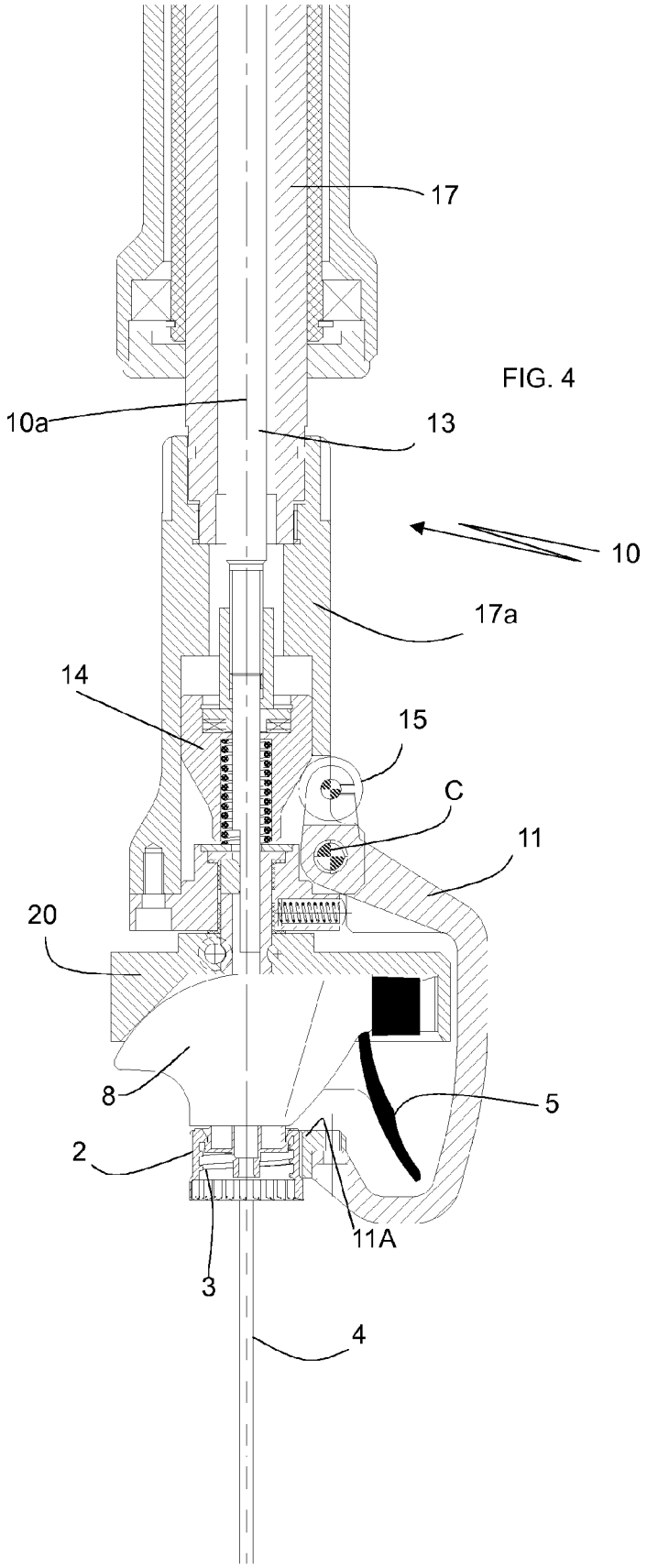
FIG. 4 shows a detail of the end portion of the gripping head.

Referring particularly to FIGS. 1 and 4, there are four views of a trigger plug, generally indicated at 1, while, referring to FIGS. 3 and 4, it is generally shown a gripping and screwing head 10 adapted to implement the method of the invention; the head 10 operates when there is, under it, a trigger pump 1 provided with a ring nut to be screwed to a corresponding vessel, shown in FIG. 2.

The assembly head 10 is rotated by a suitable motor, around a vertical axis 10*a*, while an inner stem opens and closes suitable grippers as it will be described in the following.

The trigger pump 1 comprises:

- a driving lever or trigger 5 downwardly extending and adapted to define a lever which can be driven to cause the flow of a liquid;
- a liquid suction pipe 4;
- a ring nut 2, provided with an inner thread 3 to be screwed to the corresponding mouth or neck of the vessel 6; externally it has a knurled, smooth or toothed ring;

the liquid exits, following the activation of the trigger, through a nozzle 7; the trigger 1 acts as a pump for extracting the liquid, while the nozzle 7 acts as a liquid atomizer.

Figure 5:
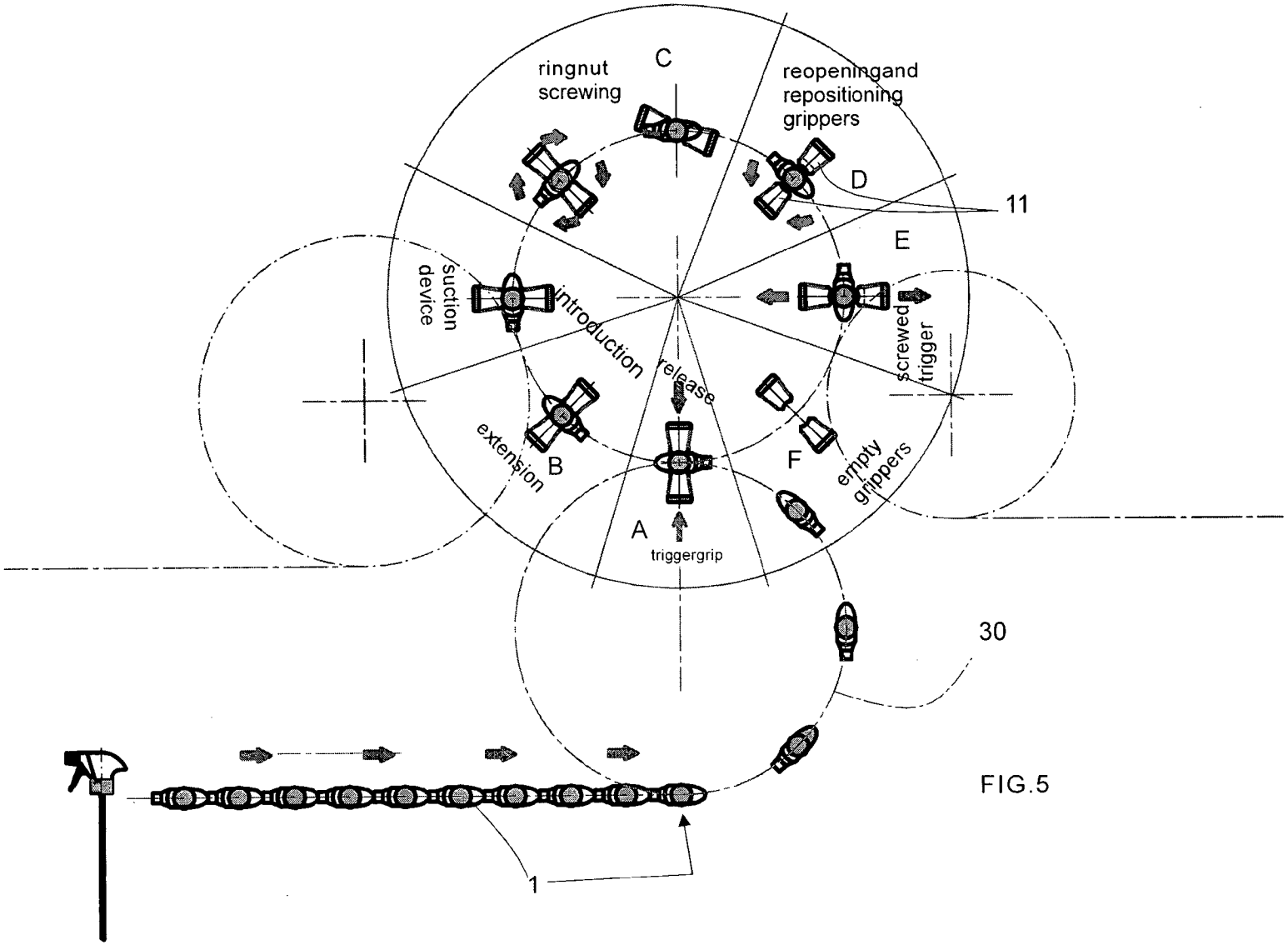
FIG. 5 is a schematic view of the method applied to a trigger transferring carousel.

Referring particularly to FIG. 5, it particularly illustrates the claimed method for screwing trigger plugs.

The process is advantageously implemented on a rotating machine, of the carousel-type, and rotatively axially supporting a plurality of gripping (and capping) heads each of them is provided with driving and control means (described in the following) of the angular position for screwing the associated trigger.

Each trigger gripping head 10 comprises two or more levers 11 adapted to take different positions, and particularly:

A first open position where it is allowed the introduction between the same of the triggers coming from an upstream line, preferably taken by another inlet star (shown in the figure by a broken line and indicated by the reference number 30).

A second closed position wherein the levers grip and block the ring nut 2 of the inserted trigger 1.

The levers 11 of the gripping assembly are driven to be opened and closed by a two-stage axially sliding cylinder 12; the cylinder 12 in its turn is connected to a stem 13 forcing a cam 14 shaped in order to move corresponding balls or rollers 15, slidingly contacting it, integral with the corresponding levers 11.

In the example, it is shown for clarity just one of the at least two ring nut gripping levers. Each lever has a shape adapted not to interfere with the trigger 5, so that it has a substantially "C" shape, wherein the bottom portion extends upwardly and terminates with a plate or slide 11A.

The cylinder 12 has two driving strokes; after the first stroke, the cam releases the ring nut gripper (allowing its independent rotation), while after the second stroke, the cam completely opens the levers so that they are not occupied by the trigger 1 plug.

Between the first and second positions, the process provides the head 10 rotation in order to move the levers 11 in a position disengaged from the trigger 5 and the trigger 1; for example, a preferred arrangement provides that the grippers are perpendicularly located to the trigger 1 plug direction, that is to the liquid outflow nozzle 7.

In fact, the levers 11 of the gripping assembly are rotatably driven by a dedicated motor 16, comprising a ratio motor adapted to directly drive (at least with some reduction gears) a hollow shaft 17 and 17*a* coaxial with said stem 13. To the shaft 17*a* are pivoted, reference C, the levers 11 for gripping the ring nut 2. To the motor 16 is associated an angular position transducer 22 or encoder, adapted to detect the position, instant after instant, of the motor shaft and of the shell and levers.

The method knows, at each instant, the relative position of the levers/trigger from the gripping instant to the instant when the screwing step ends. The motor 16 therefore performs another rotation of the lever assembly 11 in the same screwing direction or in an opposite direction, returning them in their starting configuration and avoiding possible interferences with the trigger 5; said position is adapted to locate the lever assembly perpendicularly to the body 8.

It is to be observed that the end portion of the stem 13, supports a strike 20 shaped to receive the trigger 1 body 8, by keeping it in a position aligned with the underlying vessel 6 during the screwing of its ring nut 2.

In brief, it is explained the method:

the trigger is gripped by firmly tightening it by tightening means (of the lever type, such as grippers) blocking the ring nut between the same by making it integral with them; said grip being performed by positioning the trigger outside the space occupied by the same grippers, preferably in a position substantially perpendicular between them;

the gripper and the integral ring nut are rotated once the latter is located in the relative threaded mouth of the vessel;

the ring nut 2 is screwed to the threaded mouth of the vessel, by screwing it to the body, until the screwing torque does not reach a predetermined value, after that the connection to the motor of the gripping assembly is stopped;

it is performed a first disconnection of the tightening means 11 from the relative ring nut; said operation being the minimum necessary for avoiding the contact between them;

the tightening means 11 are rotated, always by their associated motor, until they are positioned again in their starting arrangement, in other words by locating the trigger outside the space occupied by the grippers themselves, preferably in a position substantially perpendicular between them;

it is performed another opening of the tightening means 11 from the relative ring nut; said operation being necessary for completely opening the gripper and releasing the trigger.

With reference to FIG. 5, are schematically shown the different above mentioned steps performed during a complete turn of the carousel or of the head-holder rotating machine 10.

The trigger grip is indicated at A: the levers are located perpendicularly to the position of the trigger body, substantially tangent to the delivering star, indicated at 30 by a broken-line.

In the angular step indicated at B, there is an extension of the suction device and its introduction in the vessel 6 (not shown).

The step C consists of the real screwing performed by rotating the grippers 11 until it is reached the predetermined tightening torque.

The step D is dedicated to the first reopening (detachment from the ring nut) and repositioning of the grippers, as in the configuration A, in relation to the position of the trigger body: the trigger being kept tangent with respect to the rotation path, the levers 11 are moved outside the space occupied by the trigger, that is perpendicular to the body 8.

The step E shows the next complete reopening of the grippers 11 and the release of the vessel with the screwed trigger.

The step F shows that the grippers are empty and opened and ready for inserting another trigger.

The tightening levers 11 can be of the type pivoted above the trigger as shown in the figure, or parallelly pivoted to the axis 10*a* and with an angular rotation towards the same axis until they contact the ring nut 2.

The geometrical shape of the levers 11 is characterized by the fact they are pivoted to the head 10 in a point c above the trigger 1 and by-pass the trigger 5 to contact the ring nut 2.

The invention claimed is:

1. A head (10) for screwing a ring nut of a trigger pump (1) on a vessel (6), the trigger pump (1) being provided with i) a body (8), ii) a driving trigger (5), iii) a dip pipe (4) extending downward from the body (8) and intended to be inserted within the vessel (6), and iv) an externally-toothed ring nut (2) free to rotate relative to the body (8) of the pump and is internally threaded (3) in correspondence with threading provided on the neck of the vessel (6), said head (10) comprising:

a gripping unit comprised of a plurality of clamping levers (11) arranged about a longitudinal axis (10*a*), the clamping levers drivable between i) a first open position that allows an introduction of the trigger pump (1) between the levers, and ii) a second closed position where the clamping levers grip the ring nut (2) between the clamping levers;

a motor drive (16) operatively connected to axially rotate the clamping levers, when the clamping levers are in the second closed position, about the longitudinal axis (10*a*) such that the clamping levers axially rotate the ring nut (2) in a screwing-on direction to screw the ring nut (2) onto the threading provided on the neck of the vessel (6) with the clamping levers avoiding interference with the driving trigger (5) during the rotation of the clamping levers; and an electronic apparatus (22) operatively connected to the motor and configured to detect a present position of the clamping levers relative to the trigger pump (1) to thereby define or not define interference conditions of the clamping levers (11) with the driving trigger (5), wherein the clamping levers (11) are shaped such that, in the second position during rotation of the clamping levers, the clamping levers have clearance over the driving trigger (5), wherein, the clamping levers are hinged at a pivot point (C), each of the clamping levers have a substantially C shape, a bottom portion of the C shape terminating with a plate (11A) and extending first downward and then upwardly to the pivot point, a distal end of the driving trigger (5) extends a first distance perpendicular to the longitudinal axis (10*a*), and the C shape defines an inside surface of each clamping lever such that, in the second position during rotation of the clamping levers, a closest inside surface of each clamping lever to the distal end of the driving trigger (5), has a second distance perpendicular to the longitudinal axis (10*a*) greater than the first distance perpendicular to the longitudinal axis (10*a*) such that the clamping levers each have clearance over the driving trigger (5) during the rotation of the ring nut (2) in the screwing-on direction when screwing the ring nut (2) onto the threading provided on the neck of the vessel (6).

2. The head (10) according to claim 1, further comprising an axially sliding cylinder (12), wherein the clamping levers (11) are driven from the first open position to the second closed position by the axially sliding cylinder (12) moving between a first cylinder position and a second cylinder position.

3. The head (10) according to claim 1, wherein, the clamping levers (11) are hinged parallel to the longitudinal axis (10*a*) on an assembly that axially rotates about the longitudinal axis (10*a*), and an angular rotation of the assembly about the longitudinal axis (10*a*) drives clamping levers (11) from the first open position to the second closed position.

4. The head (10) according to claim 1 in combination with a rotating capping machine that rotates axially.

5. The head (10) according to claim 1 in combination with a linear capping machine.

6. A head (10) for screwing a ring nut of a trigger pump (1) on a vessel (6), the trigger pump (1) being provided with i) a body (8), ii) a driving trigger (5), iii) a dip pipe (4) extending downward from the body (8) and intended to be inserted within the vessel (6), and iv) an externally-toothed ring nut (2) which is free to rotate relative to the body (8) of the pump and is internally threaded (3) in correspondence with threading provided on the neck of the vessel (6), said head (10) comprising:

a gripping unit comprised of a plurality of clamping levers (11) arranged about a longitudinal axis (10*a*) and axially rotatable about the longitudinal axis (10*a*), the clamping levers drivable between i) a first open position that allows an introduction of the trigger pump (1) between the levers, and ii) a second closed position where the clamping levers grip the ring nut (2) between the clamping levers, wherein with the clamping levers in the second closed position, rotation of the clamping levers about the longitudinal axis (10*a*) rotates the ring nut (2) in a screwing-on direction to screw the ring nut (2) onto the threading provided on the neck of the vessel (6) with the clamping levers avoiding interference with the driving trigger (5), and wherein the clamping levers (11) are shaped such that, in the second position during rotation of the clamping levers, the clamping levers have clearance over the driving trigger (5), wherein the clamping levers are hinged at a pivot point (C), each of the clamping levers have a substantially C shape, a bottom portion of the C shape terminating with a plate (11A) and extending first downward and then upwardly to the pivot point, a distal end of the driving trigger (5) extends a first distance perpendicular to the longitudinal axis (10*a*), and the C shape defines an inside surface of each clamping lever such that, in the second position during rotation of the clamping levers, a closest inside surface of each clamping lever to the distal end of the driving trigger (5), has a second distance perpendicular to the longitudinal axis (10*a*) greater than the first distance perpendicular to the longitudinal axis (10*a*) such that the clamping levers each have clearance over the driving trigger (5) during the rotation of the ring nut (2) in the screwing-on direction when screwing the ring nut (2) onto the threading provided on the neck of the vessel (6).

7. The head (10) according to claim 6, further comprising an axially sliding cylinder (12), wherein the clamping levers (11) are driven from the first open position to the second closed position by the axially sliding cylinder (12) moving between a first cylinder position and a second cylinder position.

8. The head (10) according to claim 6, wherein, the clamping levers (11) are hinged parallel to the longitudinal axis (10*a*) on an assembly that axially rotates about the longitudinal axis (10*a*), and an angular rotation of the assembly about the longitudinal axis (10*a*) drives clamping levers (11) from the first open position to the second closed position.

9. The head (10) according to claim 6 in combination with a rotating capping machine that rotates axially.

10. The head (10) according to claim 6 in combination with a linear capping machine.

* * * * *